US010801097B2

(12) United States Patent
Brennan et al.

(10) Patent No.: US 10,801,097 B2
(45) Date of Patent: Oct. 13, 2020

(54) THERMAL SPRAY COATINGS ONTO NON-SMOOTH SURFACES

(71) Applicants: Michael S Brennan, Carmel, IN (US); Daming Wang, Carmel, IN (US); Ardy Kleyman, Carmel, IN (US)

(72) Inventors: Michael S Brennan, Carmel, IN (US); Daming Wang, Carmel, IN (US); Ardy Kleyman, Carmel, IN (US)

(73) Assignee: Praxair S.T. Technology, Inc., North Haven, CT (US)

( * ) Notice: Subject to any disclaimer, the term of this patent is extended or adjusted under 35 U.S.C. 154(b) by 436 days.

(21) Appl. No.: 15/379,652

(22) Filed: Dec. 15, 2016

(65) Prior Publication Data

US 2017/0183763 A1 Jun. 29, 2017

Related U.S. Application Data

(60) Provisional application No. 62/387,131, filed on Dec. 23, 2015.

(51) Int. Cl.
*C23C 4/01* (2016.01)
*C23C 4/10* (2016.01)
(Continued)

(52) U.S. Cl.
CPC ..... *C23C 4/01* (2016.01); *B21B 27/00* (2013.01); *B21B 27/005* (2013.01); *C23C 4/00* (2013.01);
(Continued)

(58) Field of Classification Search
CPC ... B21B 2269/14; B21B 27/005; B21B 27/00; C23C 4/00; C23C 4/01; C23C 4/02; C23C 4/06; C23C 4/067; C23C 4/126; C23C 4/073; C23C 4/11; C23C 4/14; C23C 4/16; C23C 4/18; C23C 4/10; C23C 4/134; C23C 4/08; C23C 4/129; C23C 4/12; C23C 4/123; C23C 4/131; C23C 4/137;
(Continued)

(56) References Cited

U.S. PATENT DOCUMENTS 2,714,563 A 8/1955 Poorman et al.
3,831,213 A 8/1974 Bedi
(Continued)

FOREIGN PATENT DOCUMENTS

JP S5921416 A 2/1984
JP H09256135 A 9/1997

OTHER PUBLICATIONS

R. Brocking et al.; Development of Electrical Discharge Coating (EDC) as Chrome-Free Alternative for Increasing Campaign Length of Temper Mill Work Rolls; A Publication of the Association for Iron & Steel Technology; ASITech, Nov. 2015; pp. 68-76.

*Primary Examiner* — Michael E. La Villa
(74) *Attorney, Agent, or Firm* — Nilay S. Dalal

(57) ABSTRACT

This invention relates to thermal spray coatings and processes onto non-smooth surfaces. The coating and processes can coat non-smooth surfaces without substantial degradation of the underlying surface texture or profile of the non-smooth surfaces so as to sufficiently preserve the underlying surface texture or profile. The ability for coating fractional coverage to maintain the surface profile while maintaining wear resistance is unprecedented by conventional thermal spray processes.

26 Claims, 2 Drawing Sheets

(51) Int. Cl.

| | |
|---|---|
| ***C23C 4/134*** | (2016.01) |
| ***C23C 4/08*** | (2016.01) |
| ***C23C 4/126*** | (2016.01) |
| ***C23C 4/129*** | (2016.01) |
| ***B21B 27/00*** | (2006.01) |
| ***C23C 4/02*** | (2006.01) |
| ***C23C 4/06*** | (2016.01) |
| ***C23C 4/073*** | (2016.01) |
| ***C23C 4/00*** | (2016.01) |
| ***C23C 4/067*** | (2016.01) |
| ***C23C 4/14*** | (2016.01) |
| ***C23C 4/131*** | (2016.01) |
| ***C23C 4/137*** | (2016.01) |
| ***C23C 4/18*** | (2006.01) |
| ***C23C 4/123*** | (2016.01) |
| ***C23C 4/12*** | (2016.01) |
| ***C23C 4/16*** | (2016.01) |
| ***C23C 4/11*** | (2016.01) |

(52) U.S. Cl.

CPC ..... *C23C 4/02* (2013.01); *C23C 4/06* (2013.01); *C23C 4/067* (2016.01); *C23C 4/073* (2016.01); *C23C 4/08* (2013.01); *C23C 4/10* (2013.01); *C23C 4/11* (2016.01); *C23C 4/12* (2013.01); *C23C 4/123* (2016.01); *C23C 4/126* (2016.01); *C23C 4/129* (2016.01); *C23C 4/131* (2016.01); *C23C 4/134* (2016.01); *C23C 4/137* (2016.01); *C23C 4/14* (2013.01); *C23C 4/16* (2013.01); *C23C 4/18* (2013.01); *B21B 2269/14* (2013.01); *Y10T 428/12576* (2015.01); *Y10T 428/12854* (2015.01); *Y10T 428/12931* (2015.01); *Y10T 428/12937* (2015.01); *Y10T 428/12944* (2015.01); *Y10T 428/12993* (2015.01)

(58) Field of Classification Search

CPC ..... Y10T 428/12576; Y10T 428/12854; Y10T 428/12931; Y10T 428/12937; Y10T 428/12944; Y10T 428/12993

See application file for complete search history.

(56) References Cited

U.S. PATENT DOCUMENTS

| | | | | |
|---|---|---|---|---|
| 4,519,840 | A | 5/1985 | Jackson et al. | |
| 4,626,476 | A | 12/1986 | Londry et al. | |
| 4,787,837 | A | 11/1988 | Bell | |
| 4,986,181 | A * | 1/1991 | Kobayashi ..... | B41N 7/06 101/348 |
| 6,503,290 | B1 | 1/2003 | Jarosinski et al. | |
| 8,524,375 | B2 | 9/2013 | Jarosinski | |
| 2011/0014060 | A1 | 1/2011 | Bolcavage et al. | |
| 2011/0171392 | A1 | 7/2011 | Gambino et al. | |

* cited by examiner

THERMAL SPRAY COATINGS ONTO NON-SMOOTH SURFACES

RELATED APPLICATIONS

This application claims priority to U.S. provisional application Ser. No. 62/387,131 filed Dec. 23, 2015, the disclosure of which is hereby incorporated by reference in its entirety.

FIELD OF THE INVENTION

This invention relates to thermal spray coatings onto non-smooth surfaces to create partially or fully coated surfaces for use in a variety of applications, whereby the coating sufficiently retains the underlying surface texture of the surface being coated while imparting necessary loading capacity and wear resistance.

BACKGROUND OF THE INVENTION

Many coated substrate surfaces require a coating that maintains or does not significantly degrade the underlying surface texture or patterning of the substrate surface. It should be understood that the terms "texture"; "surface texture" and "pattern" are intended to have the same meaning as used herein and throughout. As used herein and throughout, the term "substrate" refers to any non-smooth surface characterized by a certain random or non-random surface pattern or texturized profile. The substrate includes any suitable type of material, including metallic and alloy surfaces.

One example of a substrate is an embossing roll which has a configuration of depressions or grooves and/or elevated protrusions to create a certain pattern or surface texture. Another example of a substrate is a work roll with a pre-defined surface texture. For example, work rolls for use in metal or metal alloys (e.g., steel, titanium, copper, brass and aluminum, having a certain surface texture may be needed to produce rolled workpieces and other products. As used herein and throughout, "workpiece" and "product" are generic references to any type of material that the coated substrate may contact as part of a rolling process or end-use application (e.g., heat treatment, annealing and the like) including by way of example, a strip, slab or other rolled sheet metals and other sheet products. A textured work roll for hot mill and cold mill performing has certain benefits, including enabling significant reductions in the thickness of the workpiece material passing through the work roll.

Further, the work roll surface texture is desirable as it can act to entrap lubricant in what is otherwise a lubricant-depleted roll bite (the depletion of lubricant resulting from the extreme temperatures associated with hot rolling), such lubricant then being expelled to the roll/slab interface upon which time it acts to substantially minimize material transference due to adhesion between the roll surfaces and the slab surfaces and minimizes rolled-in debris and smudge on the slab surface as it enters the cold rolling stands.

Still further, large cold mill and temper mill work rolls used in the production of sheet steel are required to be endowed with a closely defined textured surface. This texture is then imparted to the sheet steel as it passes through the rolls. As the sheet is subsequently formed into some required profile, for example, a car body shell, the surface texture that it possesses play a highly significant part, firstly in the lubrication by oil that is needed during its pressing, and subsequently in the painting of the metal shell. It is known in the art that certain qualities of surface roughness and lubrication are needed in the press working of sheet steel for the car industry and other applications as well.

Many coating processes have been employed, but they fail to create suitable wear life. One example is hard chrome plating processes, which are prevalently utilized today. However, a major drawback of the hard chrome-plating process is that it uses hexavalent chromium. Due to its carcinogenic properties, the unauthorized use of Cr(VI) compounds will be banned in the European Union from September 2017 under the Regulation on Registration, Evaluation, Authorization and Restriction of Chemicals (REACH).

As an alternative, electrical discharge coatings (EDC's) have been explored, which create texturing of the underlying surface while depositing a coating onto the created texture. EDC is a surface alloying/coating process for making a hard and wear-resistant layer with an electrical discharge textured surface on a metallic substrate. Green compact and/or sintered metal-carbide electrodes have been used during electrical discharge texturing to improve roll wear resistance through surface alloying. During the EDC process, an electrical current flows through the electrode and causes ionization of the dielectric in the sparking gap. During ionization, temperatures of more than 8000K will occur, at which point local melting and vaporization of the electrode and the workpiece surface takes place to create a coated surface. The results tend to show unacceptably low levels of tungsten carbide deposited on the workpiece surface, thereby resulting in poor wear resistance.

Still further, other current coating processes are generally unable to preserve the underlying surface texture or profile of a non-smooth surface. Today, when a coating is applied to a non-smooth surface which can be generated, for example, by texturing, embossing, engraving, etching or knurling, the non-uniform surface is lost, as it is covered by the protective coating.

In view of the drawback of current coating processes, there remains a need for improved coatings and processes for producing the same that can coat non-smooth substrate surfaces to a coating content sufficient to impart protective wear resistance and not impart substantial degradation of the underlying surface texture or profile of the non-smooth surfaces, thereby sufficiently preserving the underlying surface texture or profile.

SUMMARY OF THE INVENTION

In one aspect, a partially thermally spray coated substrate including an outer surface adapted to be in contact with a workpiece, said outer surface being non-smooth and defined by an underlying texture profile, said outer surface comprising a thermal spray coating along a first region of the outer surface to produce a thermally coated first region, and, and a remainder of said outer surface characterized by the absence of the thermal spray coating along a second region of the outer surface to produce a non-coated second region, wherein said first region of the outer surface in combination with said second region of the non-coated region does not substantially alter or degrade the underlying texture profile of the outer surface, and further wherein said partially thermally spray coated surface is characterized by the absence of a non-thermal spray coating.

In a second aspect, A method for creating a partially thermally sprayed coated substrate along an outer surface of the substrate without substantial alteration of a texture profile of the outer surface of the substrate, comprising the steps of: providing the substrate with the outer surface, said outer surface being non-smooth as defined by the texture profile; providing a thermal spray device; feeding a powder or wire feedstock through the thermal spray device to produce at least a portion of-molten powder particulates; rotating the substrate; impinging the powder particles at a first region of the outer surface thereby quenching the particles to produce a thermally coated first region; maintaining a second region of the outer surface substantially devoid of the molten powder particles to produce a non-coated second region.

In a third aspect, a thermal spray coating extending along a non-smooth surface comprising: a substrate with the non-smooth outer surface characterized by an underlying texture profile having a predetermined number of peaks as measured by a profilometer; the thermal spray coating concealing the entire non-smooth outer surface at a thickness no greater than 0.0003 inches to produce a thermally spray coated surface, and further wherein the structural integrity of the underlying texture profile is sufficiently preserved; said non-smooth outer surface characterized by the absence of an electro discharge texturized coating, electroplated coating, nitride coating, carburized coating and chrome plated coating.

DETAILED DESCRIPTION OF THE INVENTION

The present invention recognizes that when a thermal sprayed coating is applied to a non-smooth surface which can be generated by texturing, embossing, engraving, etching or knurling for example, the definition of the non-uniform surface (i.e., the surface texture, profile or pattern) is lost or covered by traditional thermal spray coating deposits. The present invention offers a novel solution for overcoming disruption to the non-smooth surface while maintaining the necessary wear resistance of the non-smooth surface.

One aspect of the present invention focuses on thermal spray coatings to produce a partially thermally spray coated surface that can generally create the desired wear and corrosion resistance while substantially maintaining the resultant underlying texture or pattern of the non-smooth substrate surface. The partially thermally spray coated surface is characterized by the absence of a non-thermal spray coating, such as chrome plating, electro discharge texturized coating, electroplated coating, nitride coating and carburized coating. As will be described, the present invention in one aspect creates a thermally spray coated first region of the non-smooth outer surface in combination with a non-coated second region that does not substantially alter or degrade the underlying texture profile of the outer surface.

Figure 1A:
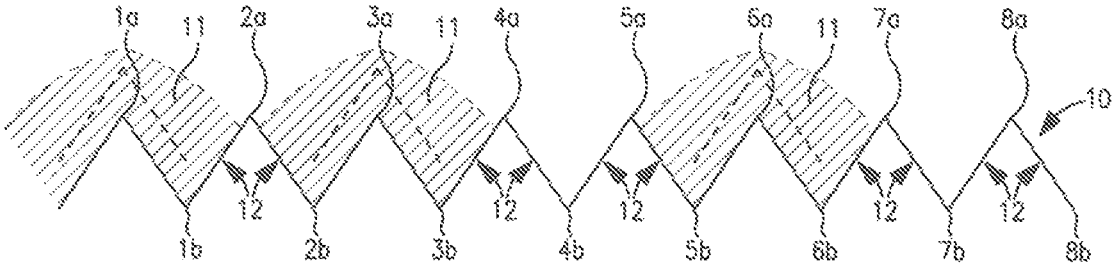
FIG. 1*a* shows a non-smooth top surface of a substrate having a thermal sprayed coating along a thermally spray coated first region whereby the localized surface texture along the coated peaks is disrupted, and the remainder of the top surface being non-coated as a second region such that the overall surface texture remains sufficient, in accordance with one aspect of the present invention.

In one embodiment, and as shown in FIG. 1*a*, a partially thermally sprayed coated substrate is provided. Any type of substrate having the need to retain the surface texture or pattern of the non-smooth surface can be employed. In a preferred embodiment, the substrate is a work roll, such as that can be utilized in processes for rolling metal alloy (e.g., steel or aluminum alloy) or other workpieces.

FIG. 1*a* shows a non-smooth top surface 10 of a work roll. The non-smooth top surface 10 is shown in its entirety as having a representative underlying surface texture defined as a series of peaks and valleys. The top portion of the non-smooth top surface 10 is shown to be surface textured as a somewhat jagged or saw-tooth profile that, by way of example, a workpiece would contact during operation. For purposes of simplicity, the non-smooth top surface 10 is not drawn to scale and the remainder of the work roll body has been intentionally omitted. Other details of the work roll have been intentionally omitted to better clarify the principles of the present invention. The peaks are numbered 1*a*-8*a* with corresponding valleys 1*b*-8*b*. Each of the peaks 1*a*-8*a* is shown as having equal height. However, it should be understood that the present invention contemplates any configuration of peaks and valleys to create the non-smooth top surface 10. Contrary to current thermal spray processes, the present invention only partially coats the non-smooth surface 10 with enough coating at discrete and multiple coated regions 11 so as to maintain the overall surface profile of the non-smooth surface 10, while still being able to create the necessary wear resistance attributes imparted by the coated regions 11. Specifically the thermally sprayed coated regions 11 is applied at irregular intervals (i.e., the spacing at which the coating is applied varies along the surface profile of the non-smooth top surface 10) along peaks 1*a*, 3*a*, and 6*a* and both sides of each of the peaks 1*a*, 3*a*, and 6*a* to produce multiple and discrete thermally spray coated first regions 11. The remainder of the substrate non-smooth surface 10 remains uncoated along peaks 2*a*, 4*a*, 5*a* and within valley 4*b*; along peak 7*a*, 8*a* and within valley 7*b*; peak 8*a* and both sides thereof and valley 8*b* to collectively produce multiple and discrete non-coated second regions 12. In the embodiment shown, ⅜ of the peaks are coated. The non-coated second region is defined by the peaks 2*a*, 5*a*, 5*a*, 7*a* and 8*a* remaining uncoated along the top of the respective peak and/or on both sides of the respective peak) of the non-smooth surface 10. The present invention recognizes that the coating may disrupt the peak and valley profile of the coated regions 1*a*, 3*a* and 6*a* to a certain degree, as can occur when, by way of example, the coating deposits along the peaks 1*a*, 3*a* and 6*a* in a way that conceals the peak features when not conforming to the peak features. For example, the thermally sprayed coated first regions 12 may reduce the effects or diminish the surface profile 10 by blunting the peak features to somewhat disrupt or conceal the localized surface texture as shown along both sides of coated peaks 1*a*, 3*a* and 6*a*. However, such reducing or blunting effects of the partial coating are offset by the non-coated second region 12, which has a surface texture 10 that remains structurally in-tact. As such, the overall surface texture can be sufficient for the particular end-use application, while still achieving the necessary wear resistance from the thermally spray coated first region 11 required for a work roll application. In this way, the present invention recognizes that a certain level of surface texture disruption can be tolerated.

The partially coated substrate can be quantified by a peak count, defined as number of peaks per unit length as detected and measured by a commercially available profilometer, such as Mahr (MarSurf) M2 unit. The peak count along the thermally spray coated region 11 in this example may be a number that is no lower than about 80% of the peak count of the non-coated region 12, preferably no lower than about 70% of the peak count of the non-coated region 12, and more preferably no lower than about 60% of the peak count of the non-coated section region 12. It should be understood that the other embodiments may exhibit similar or differing peak count, based, at least in part, on the end application.

Figure 1B:
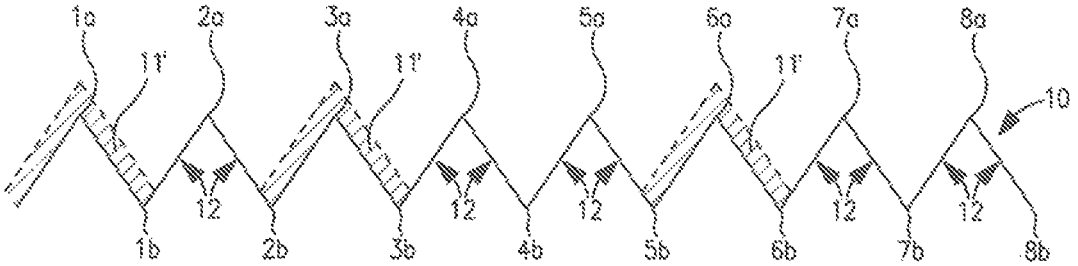
FIG. 1*b* shows a non-smooth top surface of a substrate having a thermal sprayed coating along a thermally spray coated first region whereby the localized surface texture along the coated peaks is substantially preserved to a greater degree relative to FIG. 1*a*, and the remainder of the top surface being non-coated as a second region in accordance with another aspect of the invention.

Alternatively, as shown in FIG. 1*b*, the thermally sprayed coated first region 11' may be produced so as to more precisely conform to the peaks that it deposits upon, so that the coating is applied in such a way as to maintain the integrity of the peaks 1*a*, 3*a* and 6*a*, thereby substantially preserving the surface texture 10 along the thermally spray coated first region 11' to a greater degree relative to that shown in FIG. 1*a*. For example, the use of a nano-sized thermally sprayed particle or molten particles which are sufficiently atomized to sub-micron particles may deposit in a substantially monolayer coverage over the peaks 1*a*, 3*a* and 6*a* with a reduced thickness (e.g., no greater than 0.0003 inches in one example, preferably no greater than 0.03 inches, and more preferably no greater than 0.0003 inches), thereby preserving or minimally disrupting the localized surface texture of the non-smooth surface 10 along these covered peaks 1*a*, 3*a* and 6*a* in comparison to the amount of disruption created that may be created from the coating coverage of FIG. 1*a*. As such, the overall surface texture of the partially coated substrate remains substantially unchanged to a greater degree relative to that shown in FIG. 1*a*, which may have a tendency to lose the underlying pattern arising from the non-smooth surface 10. In other words, the peak count of the thermally coated first regions 11' of FIG. 1*b* exhibit less of a detectable and measureable decrease in comparison to the peak count detected and measured for the regions 11 of FIG. 1*a*. In this way, the present invention can minimize the disruption that the thermally sprayed coating imparts to the underlying surface texture of the non-smooth surface 10. FIG. 1*b* can be advantageous when a particular application requires partial coating coverage to withstand highly loaded environments with minimal disruption of the non-smooth surface 10.

Figure 1C:
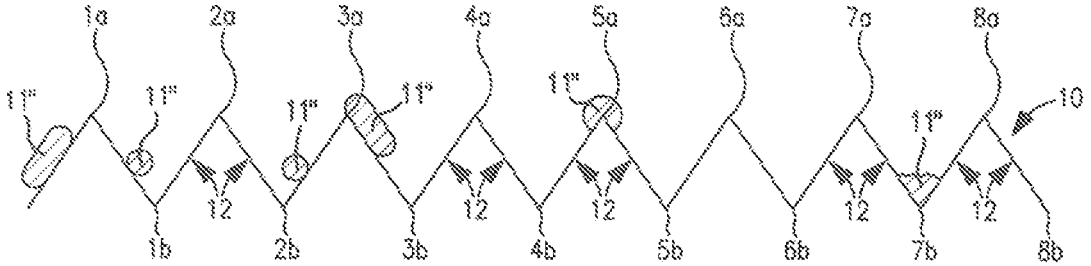
FIG. 1*c* shows a non-smooth top surface of a substrate having a thermally sprayed coating along a thermally spray coated first region, and the remainder of the top surface being non-coated as a second region in accordance with another aspect of the invention to produce a so-called pepper spray possessing greater randomness of coating in comparison to FIG. 1*a* and FIG. 1*b;*

In another embodiment shown in FIG. 1*c*, and as an extension of FIG. 1*a*, the randomness of the thermally spray coated first region 11" is increased, such that only portions of certain peaks and valleys are coated. The effect is a so-called "pepper spray" effect, which is intended to minimize coating coverage without disrupting overall surface texture of the non-smooth surface 10. The overall peak count of the non-smooth top surface 10 in FIG. 1*c* is greater than that of FIG. 1*a* and FIG. 1*b*, thereby retaining an overall higher amount of the surface texture. In some applications, the pepper spray coating configuration may be adequate where significant patterning or texture is required, and the wear resistance and loading capacity imparted from a lower amount of coating is sufficient. Other applications may require the coating configuration of FIG. 1*a* and/or FIG. 1*b*, where some level, preferably a minimum level, of disruption to the non-smooth top surface 10 is needed to attain the required wear resistance and loading capacity of the work roll. FIG. 1*c* can be advantageous when a particular application requires partial coating coverage to withstand loaded environments yet retain the underlying surface texture of non-smooth surface 10. In an alternative embodiment, the pepper spray coating configuration of FIG. 1*c*, which is defined by random-like coating particulates of varying size, shape and thickness, can be created across the entire surface, whereby discrete coating particulates in a random-like orientation are deposited along the entire surface of the substrate. The net result is that no valleys or peaks are left bare.

Figure 2A:
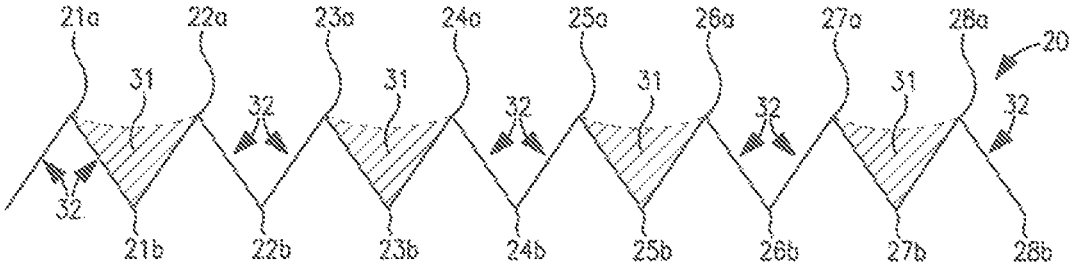
FIG. 2*a* shows a non-smooth top surface of a substrate having a thermally sprayed coating along a thermally spray coated first region, and the remainder of the top surface being non-coated as a second region in accordance with another aspect of the present invention.

FIG. 2*a* shows another embodiment. The non-smooth top surface 20 is shown as having a representative underlying surface texture defined as a series of peaks and valleys. The peaks are numbered 21*a*-28*a* with corresponding valleys 21*b*-28*b*. Unlike FIG. 1*a*, the thermally sprayed coating 11 is applied at regular intervals (i.e., equal spacing between adjacent coated to non-coated sections along the non-smooth surface 20) within valleys 21*b*, 23*b*, 25*b* and 27*b* to produce multiple and discrete thermally spray coated first regions 31. The remainder of the substrate non-smooth surface 20 remains uncoated within valleys 22*b*, 24*b* and 26*b* to collectively produce multiple and discrete non-coated second regions 32. In the embodiment shown, 8 of the so-called "legs" are coated while 8 of the legs are uncoated with a total of 16 legs, thereby resulting in approximately 50% coating coverage of the legs. Thus, the thermally sprayed coated first region 31 accounts for about 50% coverage of legs on the non-smooth surface 20. The non-coated second region 32 accounts for about 50% of the non-smooth surface.

In the embodiments described herein, the present invention recognizes that the coating may disrupt the peak and valley profile of the coated regions to a certain degree. For example, the thermally sprayed coated first regions 31 in FIG. 1*a* may at least partially conceal the features of the underlying surface profile of the non-smooth surface 20 where the coating deposits. However, such disruption of the surface texture by the partial coating can be offset by the non-coated second regions 32, which has a localized surface texture that remains structurally in-tact after the coating is applied. As such, similar to FIG. 1*a*, the overall surface texture of non-smooth surface 20 in FIG. 2*a* can be sufficient for the particular end-use application while still achieving the necessary wear resistance from the thermally spray coated first regions 31 required for a particular application, such as, by way of example, a work roll application.

Figure 2B:
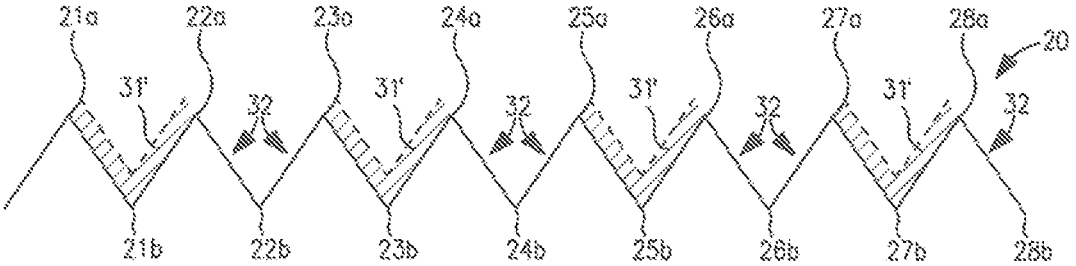
FIG. 2*b* shows a non-smooth top surface of a substrate having a thermally sprayed coating along a thermally spray coated first region whereby the localized surface texture along the coated peaks is substantially preserved to a greater degree relative to FIG. 2*a*, and the remainder of the top surface being non-coated as a second region in accordance with another aspect of the present invention.

Alternatively, in accordance with another aspect of the present invention, FIG. 2*b* shows a non-smooth top surface 20 of a substrate having a thermally sprayed coating along a thermally spray coated first region 31', whereby the localized surface texture along the coated peaks is substantially preserved, and the remainder of the top surface is non-coated as a second region 32. In comparison to FIG. 2*a*, the thermally sprayed coated first region 31' may be produced so as to more precisely conform to the peaks onto which it deposits, so that the coating is applied in such a way as to maintain the integrity within valleys 21*b*, 23*b*, 25*b*, and 27*b*, thereby substantially preserving the surface texture along the first coated region 31' to a greater degree relative to that shown in FIG. 2*a*. For example, the use of a nano-sized thermally sprayed particle or molten particles which are sufficiently atomized to sub-micron particles may deposit in a substantially monolayer coverage over the entire surface with a reduced thickness (e.g., no greater than 0.0003 inches in one embodiment), thereby minimally disrupting the surface texture of the non-smooth surface 20. As such, the overall surface texture of the partially coated substrate remains substantially unchanged. In other words, the peak count of the thermally spray coated first region 31' may exhibit a smaller detectable decrease in comparison to the peak count of the thermally spray coated first region 31. Other suitable techniques may also be employed to create the coating configuration of FIG. 2*b*. FIG. 2*b* can be advantageous when a particular application requires partial coating coverage to withstand highly loaded environments.

Although thermally sprayed first coated region is shown as multiple and discrete regions in FIGS. 1*a*, 1*b*, 1*c*, 2*a* and 2*b*, it should be understood that the present invention contemplates a thermally coated first region extending along the outer surface of non-smooth surface in a continuous manner to create a single and continuous thermally sprayed coated portion.

Figure 3:
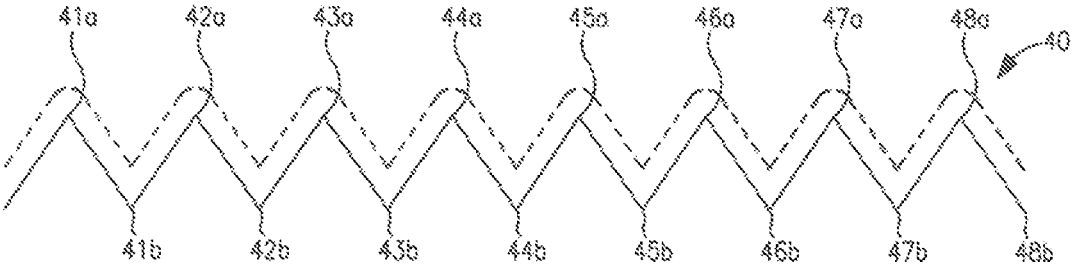
FIG. 3 shows a relatively thin thermally sprayed coating covering an entire non-smooth surface in a manner that substantially retains the underlying surface texture.

In another embodiment, FIG. 3 shows an entirely coated substrate. The non-smooth surface 40 is entirely coated with a thermally sprayed coating, which is preferably a nanosized coating. The coating process occurs in a manner that conforms to the surface texture of the non-smooth surface 40. Preferably, the thickness is no greater than 0.0015" and more preferably 0.0003". The coating structure is preferably characterized by a substantial absence of overlapping lamellae. FIG. 3 can be advantageous when a particular application requires maximum coating coverage to generate wear and corrosion resistance.

As described in the various embodiments, the present invention creates a thermally spray coated first region of the non-smooth outer surface in combination with a non-coated second region that does not substantially alter or degrade the underlying texture profile of the outer surface. FIGS. 1*a*, 1*c* and 2*a* minimize the disruption that the thermally sprayed coating imparts to the underlying surface texture of the non-smooth surface 10, whereas FIGS. 1*b* and 2*b* can preserve the underlying surface texture of the coated regions, and FIG. 3 can achieve 100% coating coverage without degradation of the underlying surface texture. The exact coating coverage may vary depending at least in part on the thermal spray process, particle size, thermal spray powder or wire feed, end-use application of the substrate and geometry of the substrate. In one example, the thermally sprayed coated first region constitutes a partial coverage of 10-90% based on a total surface area of the non-smooth surface; preferably 25-70% based on a total surface of the non-smooth surface; and more preferably 40-60% based on a total surface of the non-smooth surface.

Further, the coatings of the present invention can be expressed with respect to a Ra, defined as the average of a set of individual measurements of the non-smooth surface's peaks and valleys. For example, the thermally spray coated first region may have a surface roughness, Ra of about 50-80% of said non-coated second region. Ra as well as peak count can be used to determine how much the underlying texture profile has altered (i.e., has been reduced or degraded) by the thermal spray coating. In one example, the underlying texture profile of the outer surface along the thermally spray coated first region is altered by no more than 10-90% based on a total surface area of the non-smooth surface, and preferably no more than 20-50% based on the total surface area of the non-smooth surface.

Any suitable thermal spray process may be employed including high velocity oxy-fuel (HVOF), detonation gun, cold spray, flame spray, wire spray and plasma processes. Examples of feed material which may be used included tungsten-containing carbides, cobalt and cobalt containing alloys, nickel and nickel containing alloys, in various forms, including, powder. The thermal spray coating process generally involves flowing powder or wire feedstock through a thermal spraying device that heats and/or accelerates the powder onto a roll base (substrate). Upon impact, the heated and/or accelerated particle deforms resulting in a thermal sprayed lamella or splat. Overlapping splats make up the coating structure. A detonation process useful in this invention is disclosed in U.S. Pat. No. 2,714,563, the disclosure of which is incorporated herein by reference. The detonation process is further disclosed in U.S. Pat. Nos. 4,519,840 and 4,626,476, the disclosures of which are incorporated herein by reference, which include coatings containing tungsten, carbide, cobalt and chromium compositions. U.S. Pat. No. 6,503,290, the disclosure of which is incorporated herein by reference, discloses a high velocity oxygen fuel process useful in this invention to coat compositions containing W, C, Co, and Cr.

In the coating formation step, the thermal spraying powder is thermally sprayed onto the surface of the non-smooth surface and as a result, a thermal sprayed coating is formed on the surface of the the non-smooth surface. High-velocity-oxygen-fuel or detonation gun spraying are the preferable methods of thermally spraying the thermal spraying powder. However, other coating formation processes are contemplated and include plasma spraying; cold spray; plasma transfer arc (PTA); flame spraying; laser cladding; thermal spray/laser for fusing; PVD; CVD.

To achieve partial coating coverage onto the non-smooth surface, powder or wire feed stock is fed in the thermal spray device at a feed rate that may be lower than conventional thermal spray processes. In one example, the powder is fed through the thermal spray device at a feed rate of 5 to 120 g/min and the substrate is rotated at 900 to 3600 rpm. Other feed rates and rpm's are contemplated, and may be chosen depending upon the resultant coating coverage, coating material, coating composition and particular end-use application. Further, the powder feed rate may be allowed to vary during coating operation. While the powder feed rate is reduced, the substrate rotational speed (rpm) is increased relative to conventional thermal spray processes, thereby further reducing the density of the powder spray particles to the work roll surface. Advanced thermal spray processes utilizing sub-micron or nano-sized particles may be employed in some embodiments. Still further, the thermal spray process may be modified to attain a monolayer coverage so as to maintain the peak and valley features of a particular surface profile, thereby lowering the amount of particles contacting the workpiece without unnecessarily wasting material.

While there has been shown and described what are considered to be preferred embodiments of the invention, it will, of course, be understood that various modifications and changes in form or detail could readily be made without departing from the spirit and scope of the invention. For example, the thermal spray coatings and methods of applying as described herein can be applied directly or indirectly to a non-smooth surface of the substrate. Further, it should be understood that any type of substrate can be employed besides work rolls, including, by of example, and not intending to be limiting, embossing rolls, engraving rolls, etching rolls, knurling rolls, pinch rolls, calendar rolls, briquetting rolls, corrugating roll, metering rolls, traction rolls, Godet rolls, crimping rolls. It is, therefore, intended that the invention be not limited to the exact form and detail herein shown and described, nor to anything less than the whole of the invention herein disclosed as hereinafter claimed.

The invention claimed is:

1. A partially thermally spray coated substrate including an outer surface adapted to be in contact with a workpiece, said outer surface being non-smooth and defined by an underlying texture profile, said outer surface comprising a thermal spray coating along a first region of the outer surface to produce a thermal spray coated first region, and a remainder of said outer surface characterized by the absence of the thermal spray coating along a second region of the outer surface to produce a non-coated second region, wherein said thermal spray coated first region of the outer surface in combination with said non-coated second region does not substantially alter or degrade the underlying texture profile of the outer surface, wherein the underlying texture profile of the outer surface along the thermal spray coated first region is altered by no more than 10-90% based on a total surface area of the non-smooth surface.

2. The partially thermally spray coated substrate of claim 1, wherein said partially thermal spray coated substrate along the thermal spray coated first region has a peak count defined as number of peaks per unit length, as measured by a profilometer that is lower by no more than 80% of a peak count of the non-coated second region.

3. The partially thermally spray coated substrate of claim 1, wherein said thermal spray coated first region constitutes a partial coverage of 10-90% of a total surface area of the outer surface.

4. The partially thermally spray coated substrate of claim 3, wherein said thermal spray coated first region constitutes 25-70% of the total surface area of the outer surface.

5. The partially thermally spray coated substrate of claim 1, wherein said thermal spray coated first region has a surface roughness, Ra, said Ra of about 50-80% of said non-coated second region.

6. The partially thermally spray coated substrate of claim 1, said thermal spray coated first region characterized by a substantial absence of overlapping lamellae.

7. The partially thermally spray coated substrate of claim 1, wherein said thermal spray coated first region extends along the outer surface in a continuous manner to create a single and continuous thermally sprayed coated portion, said single and continuous thermally sprayed coated portion having a thickness no greater than approximately 0.0003 inches.

8. The partially thermally spray coated substrate of claim 1, wherein said thermal spray coating is derived from a powder having a particle size that is 1 micron or less.

9. The partially thermally spray coated substrate of claim 1, wherein said thermal spray coating is derived from a powder having a particle size that is 5 microns or less.

10. The partially thermally spray coated substrate of claim 1, wherein said thermal spray coating is_selected from the group consisting of tungsten-containing carbides, cobalt and cobalt containing alloys, nickel and nickel containing alloys.

11. The partially thermally spray coated substrate of claim 1, wherein the underlying texture profile of the outer surface along the thermal spray coated first region is altered by no more than 25-50% based on the total surface of the non-smooth surface.

12. The partially thermally spray coated substrate of claim 1, wherein said substrate is selected from the group consisting of work rolls, embossing rolls, engraving rolls, etching rolls, knurling rolls, pinch rolls, calendar rolls, briquetting rolls, corrugating roll, metering rolls, traction rolls, Godet rolls, and crimping rolls.

13. The partially thermally spray coated substrate of claim 1, further comprising a thermal spray coated first region having coverage on the outer surface of up to 80%, and the balance a non-coated second region, based on a total surface area of the outer surface of the substrate; and further wherein the underlying texture profile of the outer surface along the thermal spray coated first region is altered by no more than 25-50% based on the total surface of the non-smooth surface.

14. The partially thermally spray coated substrate of claim 1, further comprising a thermal spray coated first region having coverage on the outer surface of 70-80%, with the balance a non-coated second region, based on a total surface area of the outer surface of the substrate.

15. The partially thermally spray coated substrate of claim 1, further comprising a thermal spray coated first region having coverage on the outer surface of 40-50%, with the balance a non-coated second region, based on a total surface area of the outer surface of the substrate.

16. The partially thermally spray coated substrate of claim 1, further comprising a thermal spray coated first region having coverage on the outer surface of 30-40%, with the balance a non-coated second_region, based on a total surface area of the outer surface of the substrate.

17. The partially thermally spray coated substrate of claim 1, further comprising a thermal spray coated first region having coverage on the outer surface of 10-30%, with the balance a non-coated second region, based on a total surface area of the outer surface of the substrate.

18. The partially thermally spray coated substrate of claim 1, wherein said thermal spray coated first region extends along the outer surface in a non-continuous manner to create multiple and discrete coated portions.

19. The partially thermally spray coated substrate of claim 18, wherein said thermal spray coated first region extends along the outer surface in a non-continuous manner to create multiple and discrete coated portions at regular intervals that alternates with multiple and discrete portions of the non-coated second region.

20. A method for creating the partially thermally sprayed coated substrate of claim 1, along the outer surface of the substrate without substantial alteration of the texture profile of the outer surface of the substrate, comprising the steps of:

providing the substrate with the outer surface, said outer surface being non-smooth as defined by the texture profile;

providing a thermal spray device;

feeding a powder or wire feedstock through the thermal-spray device to produce at least a portion of-molten powder particulates;

rotating the substrate;

impinging the powder particles at a first region of the outer surface thereby quenching the particles to produce a thermal spray coated first region;

maintaining a second region of the outer surface substantially devoid of the molten powder particles to produce the non-coated second region.

21. The method of claim 20, further comprising:

impinging said molten powder particles along the outer surface in the first region at multiple and discrete locations.

22. The method of claim 20, further comprising feeding the powder through the thermal spray device at a feed rate of 5 to 120 g/min and rotating the substrate at a rpm of 900 to 3600.

23. The method of claim 20, wherein the thermal spray device is selected from the group consisting of high velocity oxy-fuel (HVOF), detonation gun, and plasma transferred arc devices.

24. The method of claim 20, further comprising imparting surface roughness to the substrate prior to creating the partially thermally sprayed coated substrate along the outer surface of the substrate.

25. The method of claim 20, wherein said partially thermally sprayed coating is applied indirectly to the non-smooth surface of the substrate.

26. A partially thermally spray coated substrate including an outer surface adapted to be in contact with a workpiece, said outer surface being non-smooth and defined by an underlying texture profile, said outer surface comprising a thermal spray coating along a first region of the outer surface to produce a thermal spray coated first region, and a remainder of said outer surface characterized by the absence of the thermal spray coating along a second region of the outer surface to produce a non-coated second region, wherein said thermal spray coated first region of the outer surface in combination with said non-coated second region does not substantially alter or degrade the underlying texture profile of the outer surface, and wherein said thermal spray coated first region constitutes a partial coverage of 10-90% of a total surface area of the outer surface to produce a pepper spray coating configuration.

* * * * *